US006065509A

United States Patent [19]

Bonney et al.

[11] Patent Number: 6,065,509

[45] Date of Patent: May 23, 2000

[54] METHOD AND APPARATUS FOR FILLING CAVITIES

[75] Inventors: Stanley George Bonney; Alan Anthony Wilson, both of Ware, United Kingdom

[73] Assignee: Glaxo Wellcome Inc., N.C.

[21] Appl. No.: 09/000,093

[22] PCT Filed: Jul. 25, 1996

[86] PCT No.: PCT/EP96/03274

§ 371 Date: Feb. 2, 1998

§ 102(e) Date: Feb. 2, 1998

[87] PCT Pub. No.: WO97/05018

PCT Pub. Date: Feb. 13, 1997

[30] Foreign Application Priority Data

Jul. 26, 1995 [GB] United Kingdom ..... 9515340

[51] Int. Cl.[7] ..... B65B 1/04

[52] U.S. Cl. ..... 141/71; 141/72; 141/12; 222/226

[58] Field of Search ..... 141/71, 72, 12, 141/11, 81, 18, 2, 237, 242, 243; 222/226

[56] References Cited

U.S. PATENT DOCUMENTS

| | | | |
|---|---|---|---|
| 3,078,685 | 2/1963 | Flournoy | 141/72 |
| 4,481,987 | 11/1984 | Burns | 141/71 |
| 4,684,041 | 8/1987 | Jones et al. . | |
| 4,688,610 | 8/1987 | Campbell . | |
| 5,143,126 | 9/1992 | Boesch et al. . | |

FOREIGN PATENT DOCUMENTS

| | | |
|---|---|---|
| 531329C1 | 8/1931 | Germany . |
| 3607187A1 | 9/1987 | Germany . |

*Primary Examiner*—Steven O. Douglas
*Attorney, Agent, or Firm*—Nixon & Vanderhye PC

[57] ABSTRACT

A blind cavity is filled with a predetermined quantity of fine powder from a hopper by bringing the cavity into a position beneath the hopper and causing the predetermined quantity of powder to flow from the hopper into the cavity. The powder is in free flowing agglomerated form and is made to flow from the hopper by subjecting the hopper to vibration, the powder flow being stopped by cessation of vibration when the cavity is filled with the predetermined quantity of powder. An apparatus for carrying out the method is also described.

28 Claims, 3 Drawing Sheets

METHOD AND APPARATUS FOR FILLING CAVITIES

This application is the national phase of international application PCT/EP96/03274 filed Jul. 25, 1996 which designated the U.S.

This invention relates to a method and apparatus for filling cavities with fine powder in free flowing agglomerated form. More particularly, it relates to a method and apparatus for controlling the flow of such powder for filling small cavities. The invention has particular application to the situation where the cavities are defined by pockets formed in a dose holder to hold doses of medicament in powder form, for example medicament which is to be inhaled by a patient, but it is also applicable to cavities defined in other ways and for alternative applications.

BACKGROUND OF THE INVENTION

It has been found that medicaments for administration by inhalation should be of a controlled particle size in order to achieve maximum penetration into the lungs, preferably in the range of 1 to 10 micrometers in diameter. Unfortunately, powders in this particle size range, hereinafter referred to as fine powders, for example micronised powders, usually have very poor flow characteristics due to the cohesive forces between the individual particles which make them readily agglomerate together to form bridges which are not readily broken apart to become free flowing. These characteristics create handling and metering difficulties which adversely affect the accurate dispensing of doses of the powder.

An apparatus for supplying particles in fine dust form in measured doses is known from DE 3607187. Powder is supplied from a hopper to a vibrator with an outlet. The hopper uses an agitator and compressed air to maintain the powder in a dry and deagglomerated form. The vibrator/outlet unit allows an approximate control of flow of the powder onto a rotating metering plate underneath, provided with a ring of pockets in its upper surface, the pockets being filled with powder as they pass underneath the outlet. As the metering plate rotates, a doctor blade wipes excess powder from the upper surface, and the doses of powder in the pockets are removed and supplied to a processing station by means of a suction tube.

Another apparatus for accurately dispensing programmed weights of particulate solids which tend to agglomerate is known from U.S. Pat. No. 4,688,610. Again, powder is supplied from a hopper with an agitator to a vibrating conveyor and on to a discharge area. A microprocessor controller is used to repeatedly read the weight of solids on the discharge area and accordingly control the activation of the agitator and vibrator to dispense precisely weighed quantities of the particulate solids.

It has been found that by careful sizing of fine agglomerated powder it is possible to make use of the cohesive forces between the particles to create agglomerates of powder which are free flowing. However, such agglomerates are easily destroyed by physical contact with other bodies, though exposure to vibration does not adversely affect them. Careful handling is therefore required to take advantage of the free flow characteristics.

SUMMARY OF THE INVENTION

It is an object of the invention to provide a method and apparatus for conveniently controlling flow of fine powder in free flowing agglomerated form for filling small cavities with predetermined milligram quantities of powder while keeping physical interaction with the powder to a minimum.

According to the invention there is provided a method of filling a blind cavity with a predetermined quantity of fine powder from a hopper, the method comprising the steps of bringing the cavity into a position beneath the hopper, and causing the predetermined quantity of powder to flow from the hopper into the cavity, characterised in that the powder is in free flowing agglomerated form and is made to flow from the hopper by subjecting the hopper to vibration, the powder flow being stopped by cessation of vibration when the cavity is filled with the predetermined quantity of powder.

The invention further provides a method of filling a cavity with a quantity of powder in free flowing agglomerated micronised form, which comprises feeding the agglomerated micronised powder from a hopper into the cavity situated beneath the hopper, whereby the powder may be made to flow from the hopper by subjecting it to vibration and the flow may be stopped by cessation of vibration.

Suitably, the frequency of vibration is in the range from 1 Hz to 1000 Hz. More suitably, the frequency of vibration is in the range from 27 Hz to 50 Hz.

Suitable amplitudes of vibration are between 0.02 mm and 2.00 mm. Preferable amplitudes of vibration are between 0.2 mm and 1.0 mm.

By use of vibration to control flow from the hopper, the powder is maintained in an agglomerated form and flows freely at a uniform rate out of the hopper outlet enabling accurate metering of flow.

Preferably the powder is a powdered medicament suitable for inhalation. Suitably, the cavity comprises a storage chamber for powder, the storage chamber being adapted for use in a powder inhalation device. Thus, the method may be used to fill the storage chamber of devices as described in European Patent No 0069715 B1, European Patent No 0237507 B1 and U.S. Pat. No. 4,805,811.

Suitably the cavity is formed in an upper face of a dose holder adapted for use in a powder inhalation device. By using accurate flow control at the outlet of the hopper it is possible to directly fill a dose holder which may subsequently be assembled into a powder inhalation device, so avoiding the need for any intermediary powder handling, processing or metering steps. One such powder inhalation device is described in UK Patent Application No 9600044.3, wherein the device comprises a housing, an outlet through which a user can inhale, a dose holder, a cavity closure member connected to the medicament holder and having a closure pad resiliently urged to close the cavity in the dose holder, and a means for moving the cavity into registration with the outlet. As the cavity is brought into registration with the outlet the closure pad is lifted away from the dose holder to allow the powder in the cavity to be inhaled.

Suitably the dose holder has a plurality of cavities, each cavity being passed beneath the hopper outlet and filled consecutively. By use of a dose holder having a plurality of cavities the method can be applied to fill different dose members having different numbers of cavities for devices intended to deliver different numbers of doses. Alternatively, each cavity may be filled simultaneously. Simultaneous filling of cavities may significantly speed up the dose holder filling process.

Suitably, the quantity of powder to be filled into each cavity is determined by the volume of each cavity. By varying the volume of each cavity it is thus possible to fill different cavities within the same dose holder with different dosages of medication to allow for a variable dosing regimen, or to fill the cavities of different dose holders with different dosages of medication without otherwise changing any apparatus.

Alternatively, the quantity of powder to be filled into each cavity is determined by the duration of the vibration. Typically, the duration of the vibration might be between 0.2 s and 1.0 s. By controlling the quantity of powder filled by the duration of the vibration it is possible to standardise dose holder and cavity size and vary the dose according to the medication and its application.

A second aspect of the invention provides an apparatus for filling a blind cavity with a predetermined quantity of fine powder, the apparatus comprising a hopper for containing the said powder and having an outlet adapted to be situated above the cavity to be filled, the hopper being provided with means for controlling flow of powder from the outlet, wherein the powder is in free flowing agglomerated form, and the outlet is of such a size and configuration as to prevent flow of the powder therethrough when in a static state and to allow flow of the powder when subject to vibration, the means for controlling flow of powder comprising a vibrating means.

The invention also provides an apparatus for filling cavities with a quantity of powder in free flowing agglomerated micronised form, which comprises a hopper for containing the said powder adapted to be situated above at least one of the cavities to be filled, the said hopper being provided with means for controlling flow of powder into the cavity, wherein the hopper has at least one outlet of such a size and cofiguration as to prevent flow of the powder when subject to vibration, and that the means for controlling flow of powder into the cavity comprises a vibrating means.

By providing an outlet of appropriate size and configuration it is possible to accurately switch the flow of the powder on and off using vibrations. Furthermore, such apparatus maintains the powder in agglomerated form and so allows exploitation of the free-flowing properties of agglomerated fine powder to ensure a uniform flow rate.

Preferably, the cavity comprises a pocket formed in an upper face of a dose holder adapted for use in a powder inhalation device.

Suitably, the dose holder is in the form of a disc having a plurality of cavities arranged in a circular configuration, and a turntable is provided for mounting the dose holder such that each cavity in turn passes beneath the outlet. By using disc shaped dose holders mounted on a turntable, dose holders having different numbers of cavities may be filled on the same apparatus.

Preferably the turntable is mounted on a vibrator. Use of a vibrator ensures that each cavity is filled with a uniform density of powder.

Alternatively, the hopper is provided with a plurality of outlets, each outlet being adapted to be situated above a respective cavity such that each cavity is filled simultaneously. Preferably, the dose holder is locked into engagement with the hopper while the cavities are filled. By locking the dose holder and hopper into engagement the powder flows directly into each cavity and the upper face of the dose holder between the cavities remains clean of powder, so obviating the need to clean the dose holder after filling.

Preferably, the vibrating means is controlled by a timer. Use of a timer allows the quantity of powder filled to be controlled.

Preferably, the hopper outlet comprises a hole. Suitably, the diameter of the outlet hole is between 1.0 mm and 3.5 mm.

Alternatively, the hopper outlet comprises a substantially horizontal powder flow pathway leading to an outlet hole. By use of such an outlet configuration the chance of overfill due to non-formation of a powder bridge is substantially eliminated.

BRIEF DESCRIPTION OF THE DRAWINGS

The invention will now be described with reference to the accompanying drawings, in which.

DETAILED DESCRIPTION OF THE INVENTION

Figure 1:
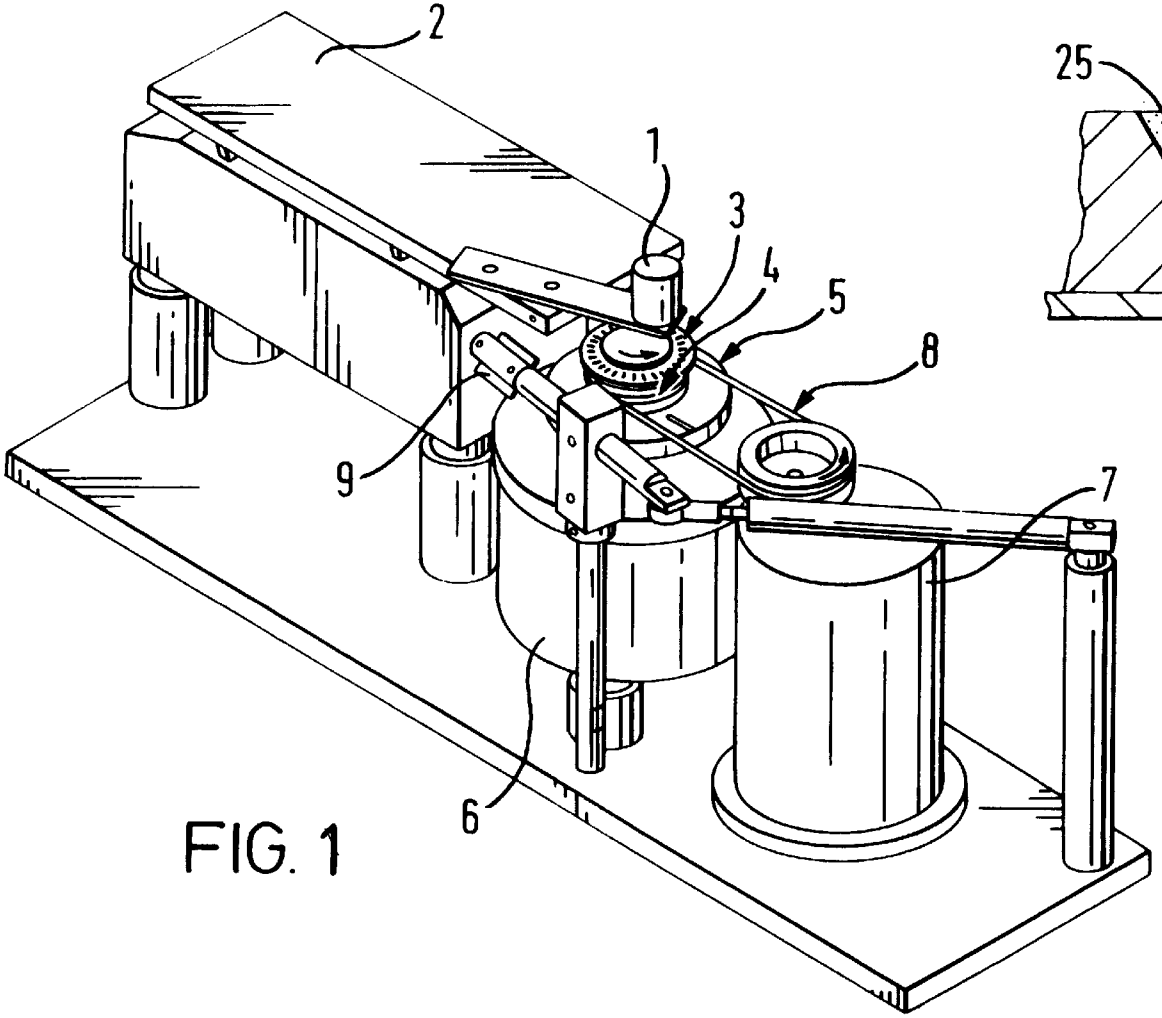
FIG. 1 is an isometric view showing an embodiment of the apparatus according to the invention.

Referring first to FIG. 1, this shows a powder hopper assembly 1 fixed to a linear vibratory feeder 2 which has its own controller enabling the adjustment of the vibratory amplitude to a given level. The powder hopper has a funnel section at its lower end with an inclusive angle of 90° terminating at an outlet hole of 3 mm diameter. Positioned below the hopper is a dose holder 3 mounted on a carrier 4 which in turn is mounted on a head 5 incorporating a powder collecting pot. The head 5 is fixed to a rotary vibratory feeder 6 which has its own controller enabling adjustment of vibratory amplitude and frequency. The dose holder 3 or dose ring comprises a flat disc with a plurality of pockets or cavities formed in one face in a circular configuration coaxial with that of the dose ring and close to its periphery.

The dose ring is suitable for carrying a plurality of doses of powdered medicament suitable for inhalation and is adapted for use in a powder inhalation device. Powdered medicaments suitable for this purpose are, for example, for the treatment of respiratory disorders such as asthma, and include salbutamol, beclomethasone, salmeterol, fluticasone, formoterol, terbutaline, budesonide, bambuterol, cromoglycate, nedocromil, triamcinolone and flunisolide, and physiologically acceptable salts, solvates and esters or any combination thereof. Preferred medicaments are salbutamol, salbutamol sulphate, salmeterol, salmeterol xinafoate, fluticasone propionate, beclomethasone dipropionate, budesonide and terbutaline sulphate. Other suitable powdered medicaments include antiviral medicaments, for example zanamivir (4-guanidino-Neu-5Ac-2en). A dose may be constituted from the contents of one or more cavities and the size of each cavity will depend on the dose to be delivered. It is to be understood that the medicament powder may consist purely of one or more active ingredients, or there may additionally be one or more carriers, for example lactose.

The dose ring is mounted such that the face presenting the cavities is uppermost, with one or more of the cavities situated underneath the outlet from the hopper.

The carrier 4 comprises a turntable which may be rotated by means of a variable speed motor 7 and drive belt 8. A doctor blade 9 is mounted for pivotal movement such that it may swing between a first position (as shown in FIG. 1) in which it is clear of the dose ring 3 and a second position (not shown) in which it lies across part of the upper face of the dose ring 3 traversing from the periphery across the region presenting the cavities. In the second position the doctor blade 9 is held just above the face of the dose ring 3 with such clearance as to prevent powder agglomerates from passing between the blade and face.

To fill the cavities, micronised drug powder, such as zanamivir powder, is sized using a conventional sieving process such that the largest axial dimension across each agglomerate is up to 500 microns. The powder is fed to the hopper manually or by use of standard mechanical powder feed apparatus. As the hopper assembly fills, after an initial small amount of powder flow through the outlet, the powder forms a bridge at the hopper outlet which prevents further flow of the powder through the outlet. To make the powder flow from the hopper out of the outlet the linear vibratory feeder 2 is set to vibrate the hopper assembly 1 with an amplitude of 0.3 mm and with a vibratory frequency conveniently of around 50 Hz. The vibrations break the powder bridge and prevent the powder from rebridging. In the absence of a bridge, the powder flows freely out of the outlet and falls onto the periphery of the dose ring 3 underneath the outlet. The dose ring 3 is also subjected to similar vibrations from the rotary vibratory feeder 6 whilst simultaneously being made to rotate slowly by virtue of carrier 4, motor 7 and drive belt 8. The effect of the vibrations is to cause the cavities at the periphery of the dose ring 3 to fill uniformly with powder as they pass underneath the hopper outlet while the dose ring 3 slowly rotates. The vibrations also help to cause excess powder in the cavities and on the upper face of the dose ring 3 to move along the face to the next cavity or to fall off the edge of the dose ring 3 and into the powder collecting pot 5. The size of the outlet hole allows rapid flow of powder out of the hopper, and the speed of rotation is set according to the flow rate of powder through the hopper outlet and the size and density of fill of the cavities about the dose ring 3, the intention being to ensure that each cavity will receive more than enough powder to fill it as it passes under the hopper outlet.

During the cavity filling process the doctor blade 9 is moved into its second position as described above and moves over the upper face of the dose ring 3 as the dose ring rotates to push away any powder remaining on the upper face and to remove any overfill of powder in the cavities. Powder removed from the upper face of the dose ring 3 by the doctor blade 9 is deposited in the powder collecting pot 5 and may be recycled.

When all of the cavities in the dose ring 3 have been filled, usually after one complete revolution of the dose member 3, the linear vibratory feeder 2 is switched off and the powder flow through the outlet hole of the hopper stops almost instantaneously through the formation of a powder bridge at the outlet.

The dose ring is allowed to complete a further revolution to ensure that the upper face of the dose ring is wiped clean of powder by the doctor blade 9. Once the upper face of the dose ring is clean the doctor blade 9 is moved away from the dose ring 3 into its first position as described above, and the filled dose ring 3 may be removed from carrier 4 and replaced with an empty dose ring for filling. For use in an inhalation device the dose ring is adapted such that the cavities may be sealed against powder loss, moisture ingression etc by means of a cover layer secured by heat sealing, adhesive or other fastening means, or through sliding contact of the upper face of the dose ring with the housing or other element of the device. Failure to provide a clean surface is likely to lead to defective sealing, and use of the doctor blade as described ensures that the surface is free from powder, so obviating the need for further preparation of the upper surface prior to assembly into the device or application of a cover layer. However, it is to be understood that other means of cleaning the upper surface of the dose ring may be used, for example a low pressure air jet.

Figure 2A:
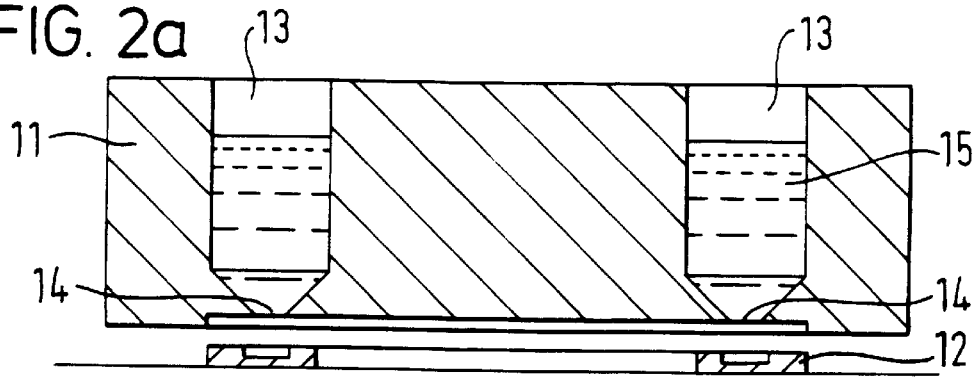
FIGS. 2*a–d* show in section a hopper and dose cavity holder according to a second embodiment of the invention at different stages during the filling process.
Figure 2B:
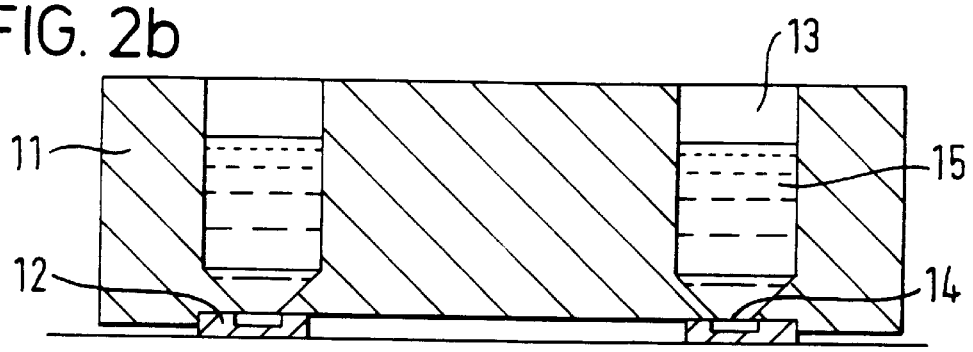

FIGS. 2*a*–2*d* show a hopper 11 and dose holder 12 suitable for use in a second embodiment of the invention. The dose holder is similar to the dose ring described with reference to FIG. 1. Hopper 11 is in the form of a multi-dose feeder ring which presents a ring shaped channel 13 for carrying the powder to be fed to the dose holder 12. At its lower end the walls of the channel converge with an inclusive angle of 90°, terminating with a plurality of outlet holes 14 each hole being of 1.6 mm diameter. Outlet holes 14 align with the cavities in the dose holder 12 when the dose holder is presented to the hopper as shown in FIG. 2*b*, such that each outlet hole is situated above a respective cavity.

To fill the cavities using the apparatus of the embodiment shown in FIGS. 2*a*–2*d*, hopper 11 is fed with free flowing agglomerated micronised zanamivir powder 15 which has been sized in the same way as the powder discussed with reference to FIG. 1. As the hopper fills, after an initial small amount of powder flow through the outlets, the powder 15 forms a bridge at each of the hopper outlets 14 which prevents further flow through the outlets. An empty dose holder 12 is presented to hopper 11 with its cavities uppermost and locked into engagement with the hopper 11 such that outlets 14 each align with a respective cavity in the dose holder 12 (FIGS. 2*a* and 2*b*).

Figure 2C:
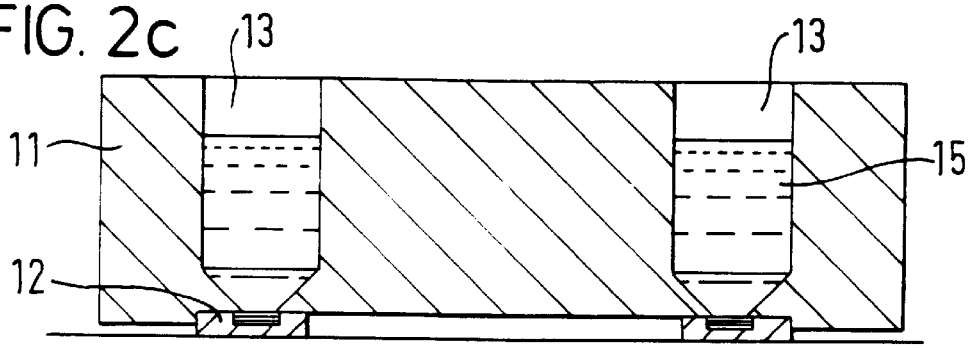
Figure 2D:
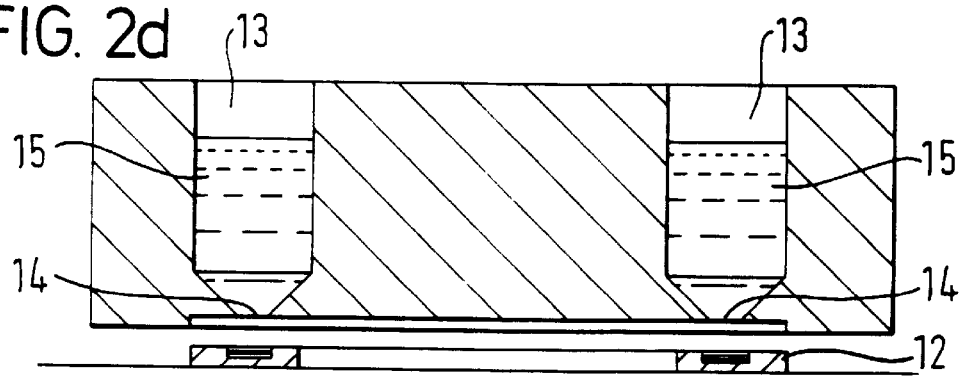
Figure 3A:
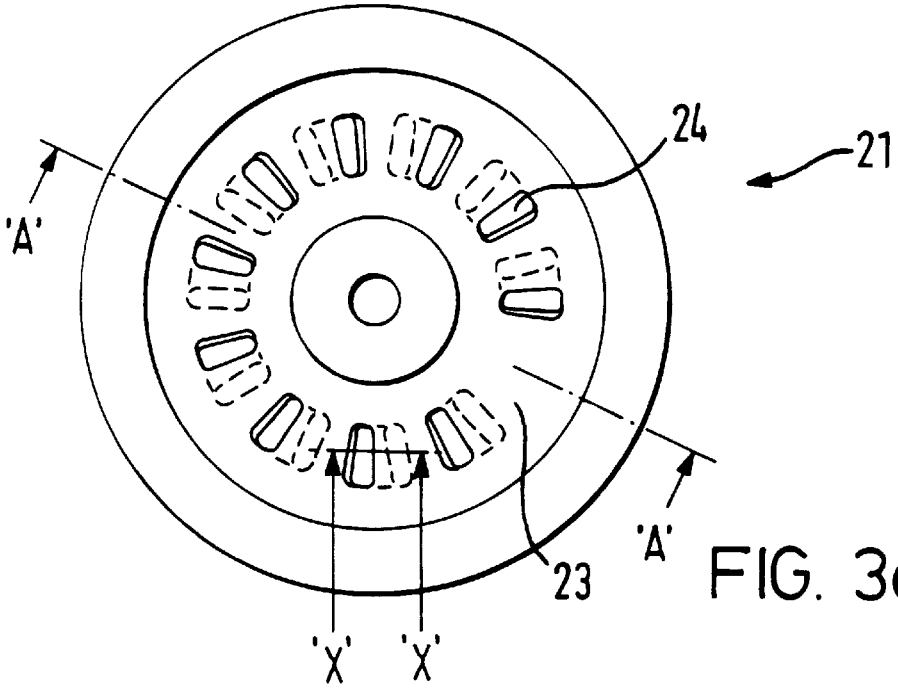
Figure 3B:
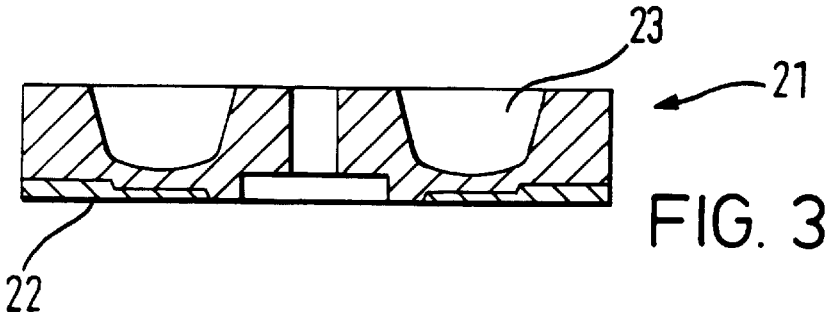
Figure 3C:
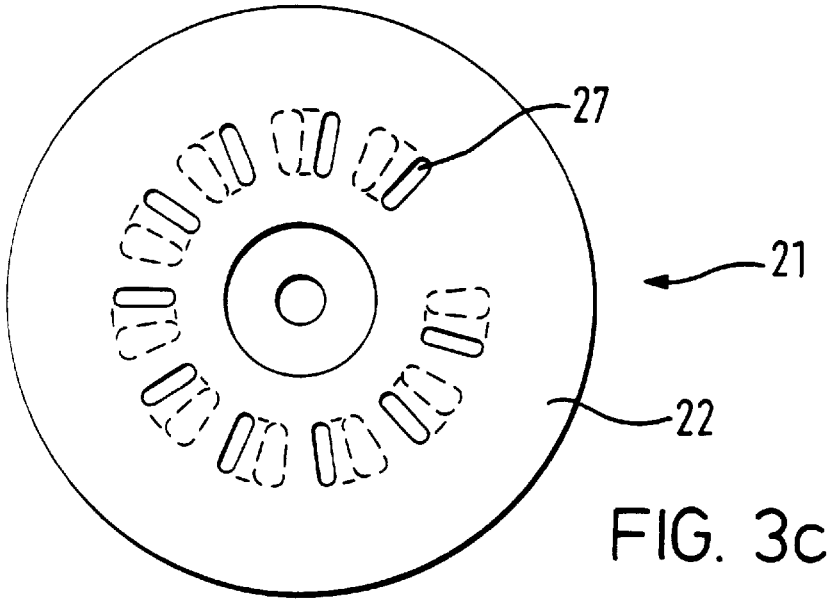

The dose holder and hopper assembly is then subjected to vibration at a frequency of 30 Hz, and an amplitude of 0.6 mm which breaks the powder bridges at each of the outlets 14 causing powder to flow freely out of the outlets with a constant flowrate into the cavities beneath (FIG. 2*c*).

The size of the outlet holes ensures a constant and controllable flow of powder from the hopper, making it possible to volumetrically fill the cavities with a predetermined quantity of powder by regulating the duration of the vibration. Each cavity has a volume sufficient to accommodate up to 16 mg of powder, but the intended dose is just 10 mg. Vibration is applied to the dose holder and hopper assembly for 0.6 s until the cavities are filled with 10 mg of powder. The vibration is then stopped and the powder in the hopper bridges over each of the outlet holes 14, so preventing any further flow of powder from the hopper. The filled dose holder 12 is then lowered away from the hopper 11 (FIG. 2*d*) and may be replaced by an empty dose holder for filling. As the dose holder 12 is lowered away from the hopper 11 the upper face of the dose holder remains clean of powder and the filled dose holder is ready for assembly into the inhalation device or application of a cover layer.

The embodiment of the invention as described with reference to FIGS. 2*a*–2*d* has the advantages of not requiring a doctor blade, powder collecting pot or an arrangement for rotating the dose holder during the filling process. It may also offer a faster method of filling the dose holder than that provided by the embodiment shown in FIG. 1 as each cavity is filled simultaneously. It is to be understood that whilst the dose holder and hopper thus described are disc/ring shaped, they could in fact be of any shape provided the hopper outlet holes align above respective cavities in the dose holder.

Figure 3D:
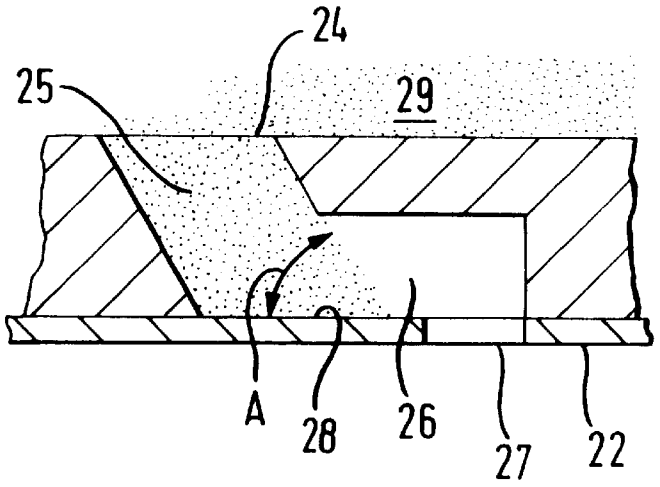
FIGS. 3*a*, 3*b*, 3*c* and 3*d* and are a plan view, a section along line A—A of FIG. 3*a*, an underside view and a section along line X—X of FIG. 3*a* showing a hopper according to a third embodiment of the invention.

Referring now to FIGS. 3*a*–3*d*, these show an alternative hopper design to that shown in FIGS. 2*a*–2*d*. Hopper 21 is again in the form of a multidose feeder ring which presents a ring shaped channel 23 for carrying the powder to be fed to the dose holder (not shown). The floor of the channel is provided with ten outlet slots 24 each of 2 mm width. As is best seen in FIG. 3*d*, each slot provides the entrance to one of ten outlet pathways each comprising a first substantially vertical section 25 followed by a second substantially horizontal section 26 and terminating in an outfeed slot 27.

In use, hopper 21 is fed with free flowing agglomerated micronised powder 29 as described with reference to FIGS. 2*a*–2*d*. The powder flows through outlet slots 24 and rests on the floor 28 of the horizontal section 26 of each of the outlet pathways. Due to the natural angle of repose A of the powder 29 (FIG. 3*d*) and the vertical offset of the outfeed slots 27 from the outlet slots 24 the powder does not naturally flow out of outfeed slots 27 as hopper 21 fills. It will be understood that the vertical offset of the outfeed slots 27 from the outlet slots 24 may be adjusted to suit the natural angle of repose of the powder intended to be used.

An empty dose holder is presented to the underside 22 of hopper 21 with its cavities uppermost and locked into engagement with the hopper 21 such that outfeed slots 27 each align with a respective cavity in the dose holder in the same way as described in relation to the embodiment shown in FIGS. 2*a*–2*d*. The dose holder and hopper assembly is then subjected to rotary vibration which causes powder on the floor 28 of the horizontal section 26 of each of the outlet pathways to flow and fall through the outfeed slots 27 into the cavities beneath as more powder flows into the outlet pathway from hopper 21 through outlet slots 24. The flowrate of powder into the cavities is substantially constant provided the amplitude and frequency of vibration remain constant so fill weight can be accurately measured by careful timing of the duration of vibrator operation.

When the cavities are sufficiently filled with the predetermined quantity of powder, the vibration applied to the dose holder and hopper assembly is stopped and flow of powder into the cavities ceases. The filled dose holder is lowered away from the hopper and may be replaced by an empty dose holder for filling in the same way as described with reference to FIGS. 2*a*–2*d*.

It will be appreciated that whilst the apparatus described with reference to the figures are specifically designed for filling cavities in a circular configuration, the invention could equally be applied with obvious modifications to the filling of cavities in any other configuration such as a long strip or a rectangular array of cavities in a dose holder. Alternatively, the invention could be applied to the filling of a cavity in the form of a storage chamber, for example for a device as described in European Patent Nos. 0069715 B1 and 0237507 B1, or U.S. Pat. No. 4,805,811.

It will further be appreciated that whilst the dimensions, vibration frequencies and amplitudes described herein with reference to the figures give good results with micronised zanamivir powder agglomerates of up to 500 microns diameter, appropriate values will depend on the size of agglomerates and the adhesive nature of the fine powder being used. It would be entirely straightforward for the skilled person to adjust these values through testing to optimise performance for different powders.

What is claimed is:

1. A method of filling a blind cavity with a predetermined quantity of fine powder from a hopper, the method comprising the steps of:

providing a hopper having a chamber for receiving powder, an upper portion through which powder is fed to the chamber, and a lower portion having at least one outlet for powder, bringing a blind cavity into a position vertically below a said outlet of the hopper, and causing a predetermined quantity of powder to controllably flow from the hopper into the cavity, wherein the powder is in free flowing agglomerated form, and wherein the powder is caused to controllably flow from the hopper solely by subjecting the hopper to vibration, the powder flow being stopped by cessation of vibration after the cavity is filled with the predetermined quantity of powder.

2. A method according to claim 1, wherein the powder is a powdered medicament suitable for inhalation.

3. A method according to claim 2, wherein the powdered medicament is zanamivir.

4. A method according to claim 2, wherein the cavity comprises a storage chamber for powder, the storage chamber being adapted for use in a powder inhalation device.

5. A method according to claim 2, wherein the cavity comprises a pocket formed in an upper face of a dose holder adapted for use in a powder inhalation device.

6. A method according to claim 5, wherein the dose holder is provided with a plurality of cavities.

7. A method according to claim 6, wherein each cavity is passed beneath the hopper and filled consecutively.

8. A method according to claim 7, wherein the upper face of the dose holder is cleaned after the cavities are filled.

9. A method according to claim 6, wherein each cavity is filled simultaneously.

10. A method according to claim 9, wherein the quantity of powder to be filled into each cavity is determined by the duration of the vibration.

11. A method according to claim 1, wherein the dose holder is subjected to vibrations.

12. A method according to claim 1, wherein the quantity of powder to be filled into each cavity is determined by the volume of each cavity.

13. Apparatus for filling a blind cavity with a predetermined quantity of fine powder, the apparatus comprising:

a hopper for containing the said powder, the hopper having a chamber for receiving the said powder, an upper portion through which powder is fed to the chamber, and a lower portion having at least one outlet for powder adapted to be respectively situated above a blind cavity to be filled, means for causing and controlling flow of powder from the outlet, wherein the powder is in free flowing agglomerated form, the outlet is of such a size and configuration as to prevent flow of the powder therethrough when in a static state and to allow flow of the powder when subject to vibration, the means for causing and controlling flow of power consisting essentially of a vibrating means whereby a quantity of powder flowing from the outlet can be accurately metered.

14. Apparatus according to claim 13, wherein the powder is a powdered medicament suitable for inhalation.

15. Apparatus according to claim 14, wherein the powdered medicament is zanamivir.

16. Apparatus according to claim 14, wherein the cavity comprises a storage chamber for powder, the storage chamber being adapted for use in a powder inhalation device.

17. Apparatus according to claim 14, wherein the cavity is formed in an upper face of a dose holder adapted for use in a powder inhalation device.

18. Apparatus according to claim 17, wherein the apparatus is adapted to handle a dose holder having a plurality of cavities.

19. Apparatus according to claim 18, wherein the dose holder is in the form of a disc and the cavities are arranged in a circular configuration.

20. Apparatus according to claim 13, wherein the hopper outlet comprises a hole.

21. Apparatus for filling a blind cavity with a predetermined quantity of fine powder, the apparatus comprising a hopper for containing the said powder and having an outlet adapted to be situated above the cavity to be filled, the hopper being provided with means for controlling flow of powder from the outlet, wherein the powder is in free flowing agglomerated form, and the outlet is of such a size and configuration as to prevent flow of the powder therethrough when in a static state and to allow flow of the powder when subject to vibration, the means for controlling flow of power comprising a vibrating means, wherein the powder is a powered medicament suitable for inhalation, wherein the cavity is formed in an upper face of a dose holder adapted for use in a powder inhalation device, wherein the apparatus is adapted to handle a dose holder having a plurality of cavities, wherein the dose holder is in the form of a disk and the cavities are arranged in a circular configuration, and wherein a turntable is provided for mounting the dose holder such that each cavity intern passes beneath the outlet.

22. Apparatus according to claim 21, wherein the turntable is mounted on a vibrator.

23. Apparatus according to claim 21, further comprising a doctor blade for wiping the upper race of the dose holder as it turns.

24. Apparatus for filling a blind cavity with a predetermined quantity of fine powder, the apparatus comprising a hopper for containing the said powder and having an outlet adapted to be situated above the cavity to be filled, the hopper being provided with means for controlling flow of powder from the outlet, wherein the powder is in free flowing agglomerated form, and the outlet is of such a size and configuration as to prevent flow of the powder therethrough when in a static state and to allow flow of the powder when subject to vibration, the means for controlling flow of power comprising a vibrating means, wherein the powder is a powered medicament suitable for inhalation, wherein the cavity is formed in an upper face of a dose holder adapted for use in a powder inhalation device, wherein the hopper is provided with a plurality of outlets, each outlet being adapted to be situated above a respective cavity such that each cavity is filled simultaneously.

25. Apparatus according to claim 24, wherein the dose holder is locked into engagement with the hopper while the cavities are filled.

26. Apparatus according to claim 24, wherein the vibrating means is controlled by a timer.

27. Apparatus for filling a blind cavity with a predetermined quantity of fine powder, the apparatus comprising a hopper for containing the said powder and having an outlet adapted to be situated above the cavity to be filled, the hopper being provided with means for controlling flow of powder from the outlet, wherein the powder is in free flowing agglomerated form, and the outlet is of such a size and configuration as to prevent flow of the powder therethrough when in a static state and to allow flow of the powder when subject to vibration, the means for controlling flow of power comprising a vibrating means, wherein the hopper outlet comprises a hole, wherein the hopper outlet for the comprises a substantially horizontal pathway leading to the hole.

28. A method of filling a blind cavity with a predetermined quantity of fine powder from a hopper, the method comprising the steps of:

bringing a blind cavity into a position beneath the hopper, and causing the predetermined quantity of powder to controllably flow from the hopper into the cavity, wherein the powder is in free flowing agglomerated form and is made to flow from the hopper by subjecting the hopper to vibration, the powder flow being stopped by cessation of vibration after the cavity is filled with the predetermined quantity of powder;

wherein the powder is a powdered medicament suitable for inhalation;

wherein the cavity comprises a pocket formed in an upper face of a dose holder adapted for use in a powder inhalation device;

wherein the dose holder is provided with a plurality of cavities;

wherein each cavity is passed beneath the hopper and filled consecutively; and wherein the upper face of the dose holder is cleaned after the cavities are filled.

* * * * *